US007427246B2

(12) United States Patent
Taniguchi et al.

(10) Patent No.: US 7,427,246 B2
(45) Date of Patent: Sep. 23, 2008

(54) BALL FOR BALL GAME AND METHOD FOR MANUFACTURING THE SAME

(75) Inventors: Harufusa Taniguchi, Hiroshima (JP); Hideomi Shishido, Hiroshima (JP); Shigeo Doi, Hiroshima (JP); Yoshihisa Okimura, Hiroshima (JP)

(73) Assignees: Molten Corporation, Hiroshima (JP); adidas International Marketing B.V., Amsterdam (NL)

( * ) Notice: Subject to any disclaimer, the term of this patent is extended or adjusted under 35 U.S.C. 154(b) by 314 days.

(21) Appl. No.: 10/539,221

(22) PCT Filed: Dec. 20, 2002

(86) PCT No.: PCT/JP02/13351

§ 371 (c)(1),
(2), (4) Date: Nov. 4, 2005

(87) PCT Pub. No.: WO2004/056424

PCT Pub. Date: Jul. 8, 2004

(65) Prior Publication Data

US 2006/0084536 A1 Apr. 20, 2006

(51) Int. Cl.
*A63B 41/10* (2006.01)

(52) U.S. Cl. ..... 473/605; 156/147

(58) Field of Classification Search ..... 473/603–605, 473/608, 611, 599; 156/147, 170, 172
See application file for complete search history.

(56) References Cited

U.S. PATENT DOCUMENTS 1,692,305 A * 11/1928 Jacobus ..... 473/603
2,211,670 A * 8/1940 Reach ..... 156/147
RE21,901 E * 9/1941 Reach ..... 156/147
4,239,568 A 12/1980 Takazawa
4,856,781 A 8/1989 Shishido et al.
5,752,890 A 5/1998 Shishido et al.
5,772,545 A 6/1998 Ou
6,302,815 B1 * 10/2001 Shishido et al. ..... 473/604
6,971,965 B1 * 12/2005 Shishido ..... 473/604

FOREIGN PATENT DOCUMENTS

DE 200 19 244 U1 1/2001
WO WO 01/83047 11/2001

OTHER PUBLICATIONS

International Preliminary Examination Report for PCT/JP02/13351 dated Jul. 20, 2004, 2 pgs.
International Search Report for PCT/JP02/13351 dated Aug. 28, 2003, 2 pgs.

* cited by examiner

*Primary Examiner*—Steven Wong
(74) *Attorney, Agent, or Firm*—Goodwin Procter LLP

(57) ABSTRACT

The ball for a ball game of the invention includes a fabric layer (1) having a spherical 12-hedron where twelve right pentagonal fabric pieces (2) are sewn together. The marginal edges of the fabric piece being folded by 90 degrees, and the marginal edges are sewn together with a sewing machine. The fabric layer is then reversed through cross-like slits (5*a*, 5*b*) formed in the fabric layer in a location opposite to a valve opening (5) (also formed in the fabric layer) in such a manner that the marginal edges are located on an inner side of the fabric layer. After the bladder is accommodated within the fabric layer through the closure hole (5), the hole (5) is closed by a patch. Onto a surface of the fabric layer, there is adhered the panels. Thereby, the ball for a ball game having no unevenness and soft feeling is attained.

14 Claims, 12 Drawing Sheets

BALL FOR BALL GAME AND METHOD FOR MANUFACTURING THE SAME

CROSS-REFERENCE TO RELATED APPLICATIONS

This application is the national stage of International (PCT) Patent Application Ser. No. PCT/JP2002/013351, filed Dec. 20, 2002, the disclosure of which is incorporated herein by reference in its entirety.

TECHNICAL FIELD

The present invention relates to a ball for ball game and method for manufacturing the same.

BACKGROUND ART

Conventionally, a ball for ball game having a construction, where air is confined, includes a bladder made of rubber where air is confined; a reinforcing layer formed outside the bladder, by which sphericality and durability are applied to the ball; and a skin layer composed of a plurality of panels adhered onto the reinforcing layer.

There is known from the U.S. Pat. No. 4,856,781 such a reinforcing layer as to be composed of twelve fabric pieces, peripheral parts of which are sewn together to obtain a spherical shape. By virtue of the reinforcing layer, there is attained a ball where user can have an extremely soft feeling by sewing the twelve fabric pieces together to obtain a fabric layer in such a manner that only one side of the twelve fabric pieces is not sewn, and the only one side serves as a hole for introducing a bladder, reversing the fabric layer through the hole, positioning a marginal part of the hole to be located inside, introducing the bladder into the fabric layer, and sewing the hole while positioning the marginal part outside.

In the U.S. Pat. No. 4,239,568, there is disclosed a technique where a spherical fabric layer is formed by adhering a plurality of fabric pieces onto a spherical hollow body made of paraffin, forming an opening in one of the plurality of fabric pieces, collapsing the plurality of the spherical hollow body into pieces, removing the collapsed pieces from the opening, and inserting a bladder through the opening.

Also, there is known a ball generally called a hand stitched ball e.g. from the U.S. Pat. No. 3,119,618. This ball is obtained by sewing the panels in such a manner that adjacent marginal edges of the panels are folded inward and sewn together to form a spherical body, and inserting a bladder into the spherical body.

In the sewn ball, a member called a backing member made of fabric is adhered to each of the panels. There is no reinforcing layer made of e.g. fabric covering the bladder.

In the construction disclosed in the above-mentioned the U.S. Pat. No. 4,856,781, the marginal part to be sewn for the hole for accommodating a bladder is located outside, whereby the spherical shape is prevented to be formed. That is, fine unevenness appearing on the surface through the panels due to the marginal part to be sewn. This phenomenon is generally known as the mirror-through effect, and causes the balls to be swayed.

In the fabric layer disclosed in the U.S. Pat. No. 4,239,568, the fabric pieces are adhered onto the spherical hollow body in such a manner that the marginal edges of adjacent fabric pieces are superimposed. The superimposed parts prevent the ball from forming a spherical shape, and fine unevenness appears on the surface of the panel. In the construction of the U.S. Pat. No. 4,239,568, the fabric pieces are not sewn together. There is not any knowledge in which the fabric layer is reversed.

Normally, a valve is the biggest element in essential elements of the bladder. In order to insert the bladder into the spherical fabric layer, the hole is required to have a size where the valve can be passed through the hole. That is, preferably the hole has a diameter of about 15 mm. The bladder is made of rubber, and have an elasticity. Accordingly, the elements of the bladder other than the valve can be easily passed through the hole by expanding and stretching them.

On the other hand, when the fabric layer is reversed, the hole is required to have a minimum diameter of about 20 mm even in the case of class 3 of the soccer ball which is the smallest soccer ball. The size of the hole for reversing the fabric layer is different from that for only inserting the bladder. The hole for reversing the fabric layer in the soccer ball is required to have substantially the same size as the size of the hole for reversing the fabric layer in the volley ball. The hole for reversing the fabric layer in the basket ball is required to have a size larger than the size of the hole for reversing the fabric layer in the soccer ball.

In the construction of the ball disclosed in the U.S. Pat. No. 4,239,568, the superimposed parts of the fabric pieces contribute to the mirror-through effect, and in order to reduce the mirror-through effect there is employed such a construction where the superimposed parts of the fabric pieces correspond to the boundaries of the panels. Nevertheless, it is impossible to completely remove the mirror-throughеffect.

Further, as described in the U.S. Pat. No. 3,119,618, in the sewn ball having no spherical reinforcing layer the tensile strength in the part where the adjacent panels are sewn together is different from that in the center part of each of the panels, because the parts where the adjacent fabric pieces are sewn together using threads have a higher strength. For that reason, there is the problem that a ball having high sphericity cannot be obtained, because the central part of the panels are expanded. Further, the sphericity of the ball depends largely on the strength of the thread used for sewing the panels together. It is almost impossible to obtain the ball having homogeneous strength because of a workmanship, or a dispersion of the tensile strength even by the same workman.

The present invention was made in view of the circumstances as mentioned above. The object of the present invention is to provide a method for manufacturing a ball having a spherical fabric layer comprising a plurality of fabric pieces by which a sphericity is significantly improved, providing a hole for reversing the fabric layer through the hole in the case where all of the parts (for instance marginal parts of the plurality of fabric pieces) which prevent the sphericity are located inside to make the surface of the fabric layer completely spherical, the mirror-through effect is prevented from occurring, and accommodating a bladder through the hole; and a ball for ball game manufactured by the method.

DISCLOSURE OF INVENTION

One aspect of the invention is method for manufacturing a ball for ball game, said ball comprising:

(a) a bladder including a valve for introducing air into said bladder;

(b) a fabric layer located outside said bladder comprising a plurality of fabric pieces, wherein marginal edges of each of said plurality of fabric pieces is inwardly folded, wherein one of said marginal edges of one of said plurality of fabric pieces and one of said marginal edges of the other one of said plurality of fabric pieces adjacent to said one of said plurality of fabric pieces are sewn together by a sewing machine to form a spherical shape, wherein a valve opening is formed in one of said plurality of fabric pieces, and a hole for closure sewing to reverse said fabric layer and accommodate said bladder is formed in the other one of said plurality of fabric pieces opposed to said one of said plurality of fabric pieces; and (c) a skin layer located outside said fabric layer, said skin layer comprising a plurality of panels;

said method comprising steps of:

(i) superposing said marginal edge of one of said plurality of fabric pieces with said marginal edge of the other one of said plurality of fabric pieces adjacent to said one of said plurality of fabric pieces, sewing the same together by a sewing machine, and locating said marginal edge on an outside to form a spherical fabric layer;

(ii) reversing said fabric layer through said hole for accommodating said bladder to locate said marginal edge on an inner side;

(iii) accommodating said bladder through said hole for accommodating said bladder within said fabric layer;

(iv) closing said hole for accommodating said bladder; and (v) forming said skin layer on an outer surface of said fabric layer.

By this method, a surface of the fabric layer can be a flattened plain where there is no unevenness on the surface, and mirror-through effect can be completely avoided.

Preferably, a patch is abutted onto a peripheral part of said hole for accommodating said bladder, and said patch is adhere to said fabric piece whereby said hole is closed. Thereby, the patch is adhered to the fabric layer with adhesive to close the hole, spherical fabric layer is completed, and the hole is located to oppose to the valve. As a result, the patch serves as a means for balancing the weight to the valve.

Preferably, a patch is abutted onto a peripheral part of said hole for accommodating said bladder, said patch is sewn together with said fabric piece by a sewing machine through a valve opening formed in said fabric layer. Thereby, the patch is sewn together with the fabric layer to close the hole, the spherical fabric layer is completed, and the hole is located to oppose to the valve. As a result, the patch serves as a means for balancing the weight to the valve.

Preferably, a patch is abutted onto a peripheral part of said hole for accommodating said bladder, said patch is sewn together with said fabric piece by hand stitch to close the hole. In that case, valve opening is used.

Preferably, said hole for accommodating said bladder is comprised of two slits perpendicularly crossed to each other, said slits have a minimum length of 20 mm and a maximum length where a minimum distance from a leading end of said slits to an edge of said fabric piece is set under a condition that said minimum distance is at least 10 mm, and wherein said length of said slits is ranged between the minimum length and the maximum length. Thereby, the hole is formed into a cross-like-shaped slit, and the cross-like-shaped slit can be completely closed. As a result, the strength in the patch is constantly maintained, the spherical shape can be maintained, even if the fabric layer is subjected to pressure from the bladder. Because, if the hole has a circular shape, the strength in the circular hole is smaller than that in the periphery of the circular hole where the patch is superimposed with the fabric layer. The patch located inside the circular hole might be expanded due to the pressure from the bladder.

Since the length of the slit is defined to have a range as mentioned above, reversing procedure of the fabric layer can be performed by the minimum length, and lowering of the strength caused by the formation of the slit can be prevented by the maximum length.

Preferably, said hole for accommodating said bladder is closed through said valve opening by a sewing machine. Thereby, by the sewing procedure, the hole is closed to complete a spherical fabric layer, the restitution property and the flexibility of the parts which are sewn together are maintained in the same values of the periphery of the slit.

Preferably, said fabric layer is comprised of twelve right pentagonal fabric pieces. Thereby, twelve right pentagonal fabric pieces are sewn together to form a right dodecahedron (12-hedrodn). As a result, a spherical body is obtained by spherically and outwardly deforming each plain constituting the right dodecahedron. In the spherical fabric layer of the right dodecahedron, a spherical body is obtained without applying big strain to the spherical piece under the condition that seam lines are equally scattered on a spherical surface. Further, number of the sewing line can be reduced, so that sewing procedure can be performed in a reduced time.

Preferably, said fabric piece is comprised of two fabric pieces laminated to each other, a warp direction of one of said two fabric pieces is perpendicular to a warp direction of the other one of said two fabric pieces. In a case of a single layered fabric piece in the conventional ball, tensile strength of the warp direction is different from that of the weft direction (normally, tensile strength of the warp direction is bigger than that of the weft direction). By virtue of the construction having two layered fabric piece (i.e., superimposed two fabric pieces) of the invention, the strength of the warp direction is substantially the same as that of the weft direction. Two fabric pieces are superimposed under the condition that the warp direction is perpendicular to the warp direction. Thereafter, the superimposed fabric pieces are adhered to each other by subjecting to immersion with latex paste.

Preferably, said each of said plurality of panel is comprised of a surface layer and a shock absorbing layer adhered to a rear surface of said surface layer, wherein marginal edge of said surface layer is inwardly circularly turned by 90 degrees, whereby a side surface of said shock absorbing layer is covered with said inwardly turned marginal edge, and wherein said panel is adhered to said fabric layer with adhesive. Thereby, the cushion property of the panels are improved by the shock absorbing layer. In the connecting part between the adjacent panels, there is formed a steep grooves having V-like shape in section which are found in a conventional hand stitched ball where panels are sewn together in such a manner that marginal edges of the panels are circularly folded by 90 degrees and the marginal edge of one of the panels is sewn together with the marginal edge of the other one of the panels adjacent to said one of the panels. The gripping property of the ball is improved and air resistance is lowered by the grooves.

Preferably, said inwardly turned marginal edge of one of said plurality of panels is adhered to said inwardly edge of the other one of said plurality of panels adjacent to said one of said plurality of panels with adhesive. Thereby, the connecting face of adjacent panels are firmly connected without generating any gap.

Preferably, said skin layer is formed by superposing two panels, sewing marginal edge of said superimposed panels, and turning circularly said marginal edge by 90 degrees which are sewn together in such a manner that said marginal edge is located on an inner side. Thereby, sewing quality such as sewing strength between adjacent panels can be stable.

Preferably, said turned skin layer is adhered to said fabric layer with adhesive. Thereby, the connecting face of adjacent panels are firmly connected without generating any gap.

Another aspect of the invention is method for manufacturing a ball for ball game, said ball comprising:

(a) a bladder including a valve for introducing air into said bladder;

(b) a fabric layer located outside said bladder comprising a plurality of fabric pieces, wherein marginal edges of each of said plurality of fabric pieces is inwardly folded, wherein one of said marginal edges of one of said plurality of fabric pieces and one of said marginal edges of the other one of said plurality of fabric pieces adjacent to said one of said plurality of fabric pieces are sewn together by a sewing machine to form a spherical shape, and (c) a skin layer located outside said fabric layer, said skin layer comprising a plurality of panels;

said method comprising steps of:

(i) forming a hole in one of said plurality of fabric pieces;

(ii) superposing said marginal edge of one of said plurality of fabric pieces with said marginal edge of the other one of said plurality of fabric pieces adjacent to said one of said plurality of fabric pieces, sewing the same together by a sewing machine, and locating all of said marginal edges on an outer side to form a spherical fabric layer;

(iii) reversing said fabric layer through said hole, and locating all of said marginal edges on an inner side, said marginal edge serving as a part to prevent said fabric layer from spherically forming, and allowing outer surface to be a completely smooth spherical surface;

(iv) accommodating said bladder within said fabric layer through said hole;

(v) abutting a patch on said hole from an inside of said fabric layer to close said hole; and (vi) forming said skin layer on an outer surface of said fabric layer.

Thereby, in the surface of the fabric layer there are completely eliminated fine level differences caused by partial superposing of the fabric pieces and unevenness. As a result, high sphericity can be attained throughout the fabric layer, and smooth spherical surface can be achieved in all of the surface on the fabric layer. Also on the skin layer comprising the panels formed on the fabric layer, fine level differences and unevenness can be prevented from generating.

The other aspect of the invention is a ball for ball game comprising:

a bladder including a valve for introducing air into said bladder;

a fabric layer located outside said bladder; and a skin layer located outside said fabric layer, said skin layer comprising a plurality of panels;

wherein said fabric layer is comprised of a plurality of fabric pieces which are spherically connected with each other;

wherein all parts to prevent said fabric layer from forming a spherical shape are located on the inner side of said fabric layer, said parts being formed in a part where said plurality of fabric pieces are spherically connected;

wherein said bladder is deformed in response to said parts to prevent said fabric layer from forming a spherical shape, and said parts to prevent said fabric layer from forming a spherical shape are absorbed, whereby an outer surface of said fabric layer having a complete spherical shape is maintained without affecting of said parts to prevent said fabric layer from forming a spherical shape, such that an outer surface of said skin layer having a complete spherical shape is maintained.

Thereby, in the surface of the fabric layer there is no fine unevenness caused by e.g. partial superposing of the fabric pieces, and correspondingly on the surface of the skin layer there is no fine unevenness. As a result, the ball having a spherical surface with high precision can be attained.

BEST MODE FOR CARRYING OUT THE INVENTION

The embodiment to which the invention is applied will be explained with reference to the drawings.

Figure 1:
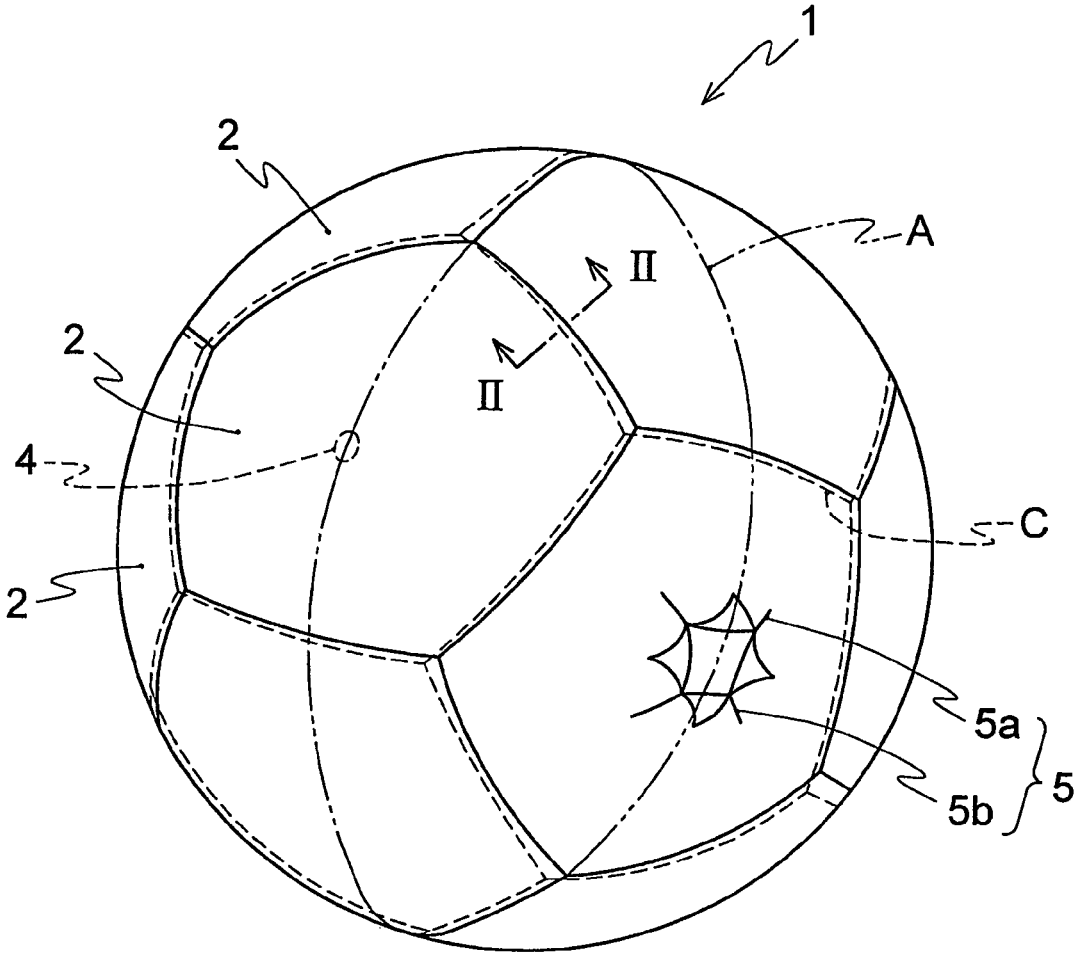
FIG. 1 is a perspective view showing a fabric layer of a ball for ball game of the invention.
Figure 2:
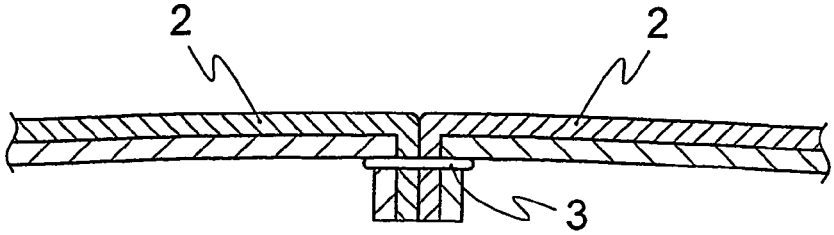
FIG. 2 is a cross sectional view taken on line II-II of FIG. 1.
Figure 3:
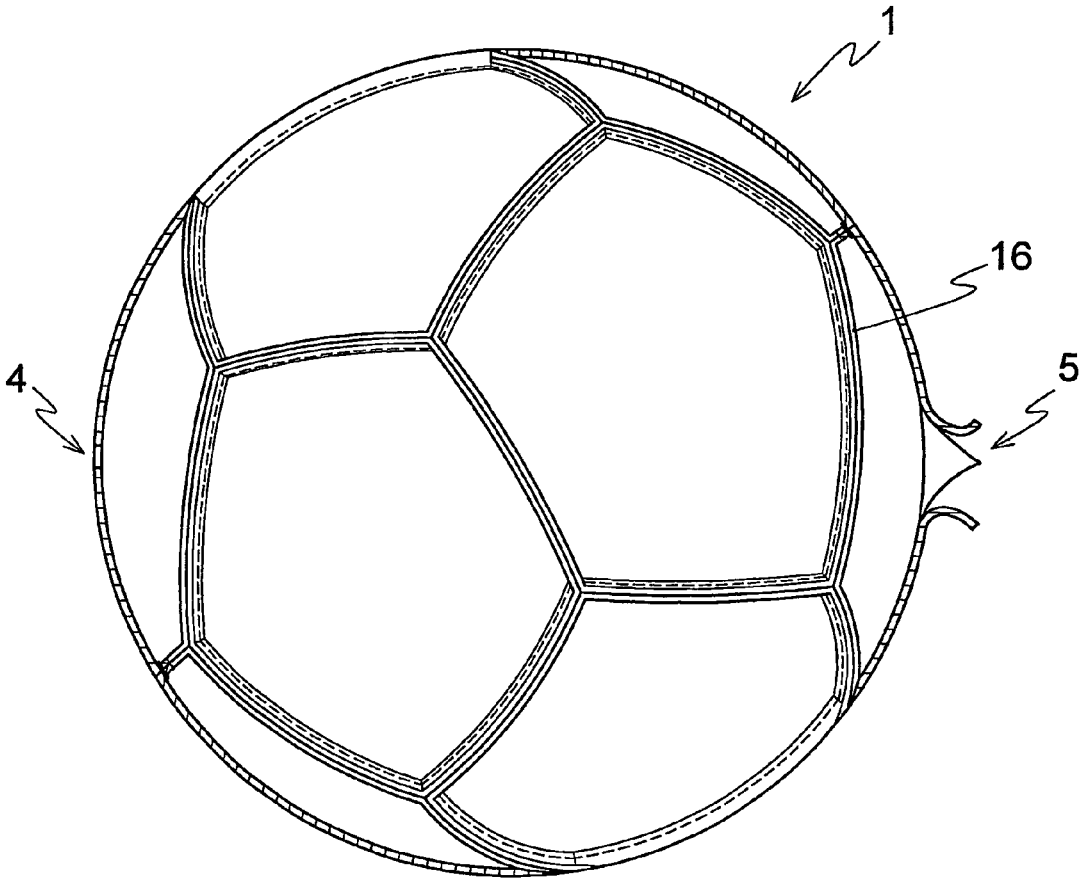
FIG. 3 is a cross sectional view cut along a circumference corresponding to a line A in FIG. 1.

In FIGS. 1 to 3, numeral 1 denotes a fabric layer where twelve pentagonal fabric pieces 2 are sewn together to form a spherical shape. The fabric layer 1 serves as a reinforcing layer. Marginal edge of the fabric piece 2 is folded inward by 90 degrees. The folded part of one fabric piece 2 and the folded part of the other fabric piece 2 are sewn together with thread 3. The fabric layer 1 is spherically formed having a construction of a regular dodecahedron sewn together by a sewing machine.

Numeral 4 denotes a valve opening formed at the center of one of the fabric pieces 2, the valve opening having a diameter of about 10 mm. When a needle for introducing air is inserted into the valve, air is introduced into the bladder.

Numeral 5 denotes a hole formed at the center of the fabric piece 2 opposed to the fabric piece 2 where the valve opening 4 is formed. The hole 5 is comprised of a slit 5*a* and a slit 5*b* which is perpendicular to the slit 5*a*. That is, the hole 5 is a cross-like shaped slit. The hole 5 is used for the hole for reversing the fabric layer 1 and a hole accommodating the bladder into the fabric layer 1. In FIG. 1, the connection between adjacent fabric pieces 2 on the back surface of the fabric layer is denoted by a dashed line C.

In order to reverse the fabric layer 1 (i.e., make the fabric inside out), as a minimum length the slit 5*a* and the slit 5*b* have necessarily a length of 20 mm respectively, even in the case of the ball having a diameter of about 19 cm, the ball is called as class-3 soccer ball used by students of elementary schools. If the length is smaller than 20 mm, then the reversing procedure is difficult to be performed. In the case of ball having a diameter of about 22 cm (so-called a class-5 soccer ball) which is mainly used by adult players, the slit 5*a* and the slit 5*b* have necessarily a length of at least 40 mm respectively. The longer the length of the slits 5*a*, 5*b*, the lower the strength of the fabric piece 2 although the reversing procedure is easier. For that reason, it is not preferable to have slits 5*a*, 5*b* with a length longer than the minimum length required for the reversing procedure.

Figure 4:
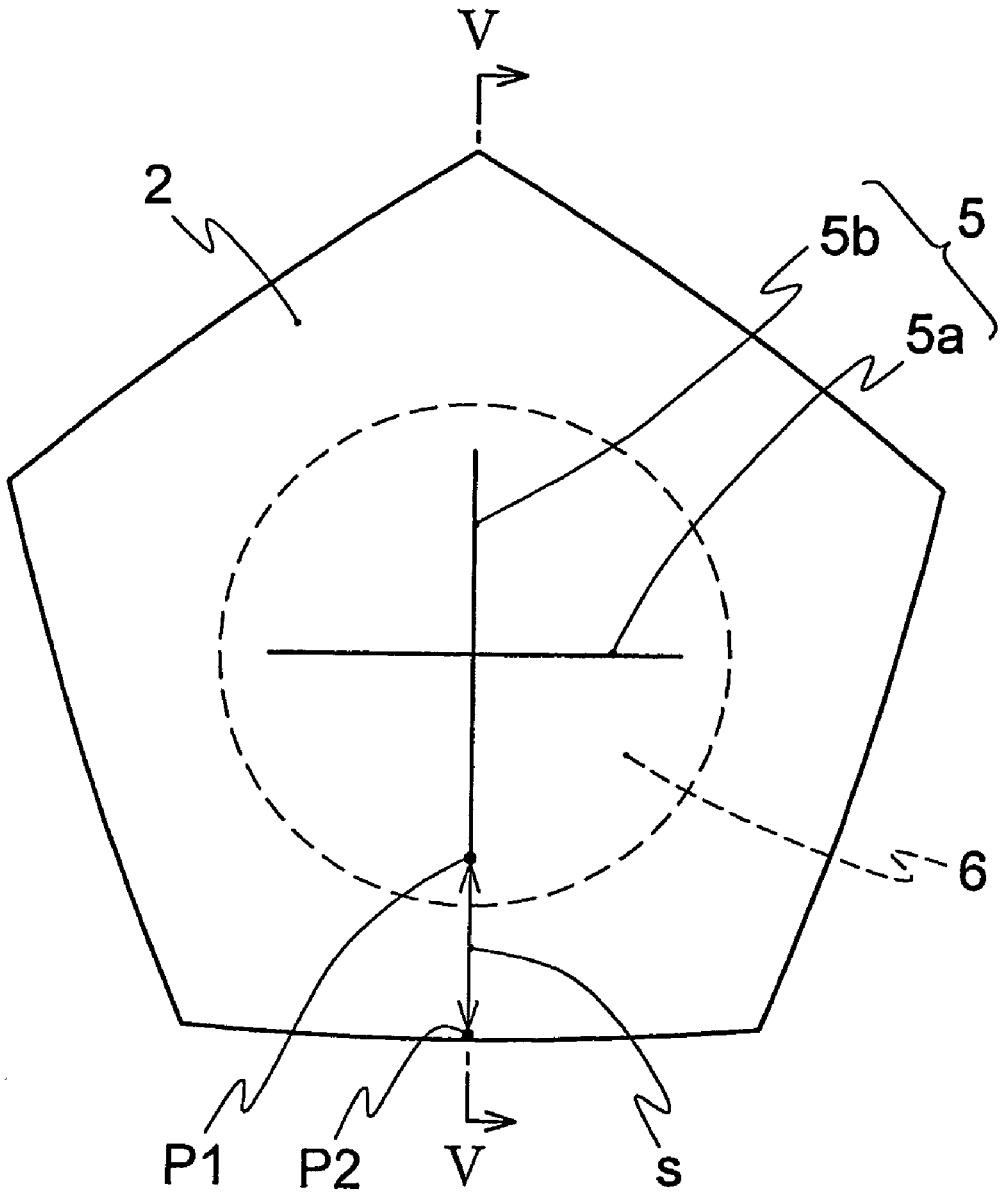
FIG. 4 is a front view of a closing structure of a fabric piece seen from an inside of the ball, said fabric piece having a slit-like shaped hole for reversing the fabric layer and accommodating a bladder.

That is, in order to maintain the desired strength of the fabric piece 2, the maximum length of the slits 5*a*, 5*b* is determined by the need to have a minimum distance s of about 10 mm between the end P1 of the slits 5*a*, 5*b* and the point P2 which is located on the peripheral edge of the fabric piece 2 (see FIG. 4). Then, the length of the slits 5*a*, 5*b* is set between the maximum length and the minimum length. If the length of distance s is less than 10 mm, then the strength of the fabric piece is decreased and there is the possibility that a breakage is generated in the portion located between the point P1 and the point P2 as the soccer ball is repeatedly used.

For instance, in the case of the class-5 soccer ball, a side of the fabric piece 2 has a length of 76 mm. In that case, a circle inscribed with an outline of any one of fabric pieces 2 has a diameter of 53.2 mm. Then, in the condition that the value of s is 10 mm, the maximum length of the slits 5*a*, 5*b* is about 84 mm. In this embodiment (i.e., the class-5 soccer ball), the hole 5 is comprised of the slit 5*a* and the slit 5*b* which is perpendicularly crossed with the slits 5 having the length of 50 mm at the center of the slits 5*a*, 5*b* to form a cross-like shape.

Further, in the condition where the fabric layer 1 is comprised of twelve pentagonal fabric pieces and twenty hexagonal fabric pieces to form a semi-regular dotriacontahedron, a cross-like shaped slit is formed at the center of one of the twenty hexagonal fabric pieces and the value of s is 10 mm, the maximum length is about 58 mm.

The hole 5 is required to be completely closed by sewing the peripheral part of the slits. For that reason, the slit-like shaped hole is preferable rather than circular-shaped hole. That is, if the circular shape is employed as a shape of the hole 5, a patch which is located within the circular-shaped hole is subjected to a pressure of the bladder. Thereby, the patch is expanded, so that the spherical shape of the fabric layer 1 is not possibly maintained. On the other hand, if the slit-like shape is employed as a shape of the hole 5, spherical shape of the fabric layer 1 is possibly maintained. Further, the greater the number of slits, the less the strength of the fabric piece 2. Accordingly, two slits 5*a*, 5*b* which bisect each other at right angles is the most preferable.

Besides, if the hole 5 is comprised of the slits 5*a*, 5*b* having a length within the above-mentioned range, the bladder is easily accommodated into the reversed fabric layer 1. As mentioned before, if the slits 5*a*, 5*b* have a length of about 15 mm, the bladder can be accommodated through the slits. However, the fabric layer cannot be reversed through the slits having a length of about 15 mm.

Figure 5:
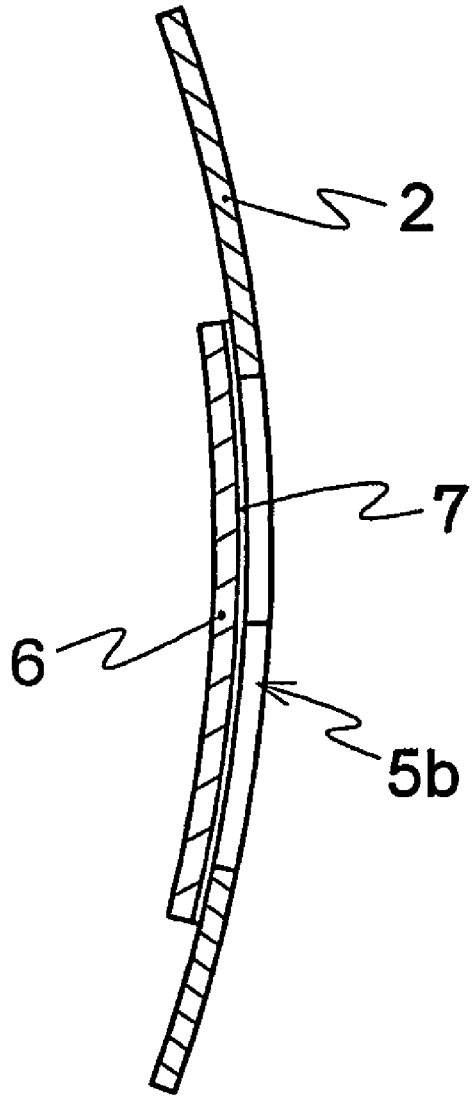
FIG. 5 is a cross sectional view taken on line of V-V of FIG. 4.

As shown in FIGS. 4 and 5, the hole 5 in the fabric piece 2 is closed by adhering a patch 6 to the fabric piece 2 from an inner side of the fabric layer 1 with adhesive 7 such as latex paste. The patch 6 is made of fabric having the same material and construction, where two woven fabric are adhered to each other, as those of the fabric piece 2, and has a disc-like shape, diameter of which is about 60 mm. If the patch 6 is located outside the fabric layer 1, the patch 6 is protruded by a thickness of the patch when the bladder is accommodated, and thereafter the bladder is inflated with air. As a result, the protruded patch possibly gives rise to the mirror-throughe-ffect. For that reason, the patch 6 is located inside the fabric layer 1.

Figure 6:
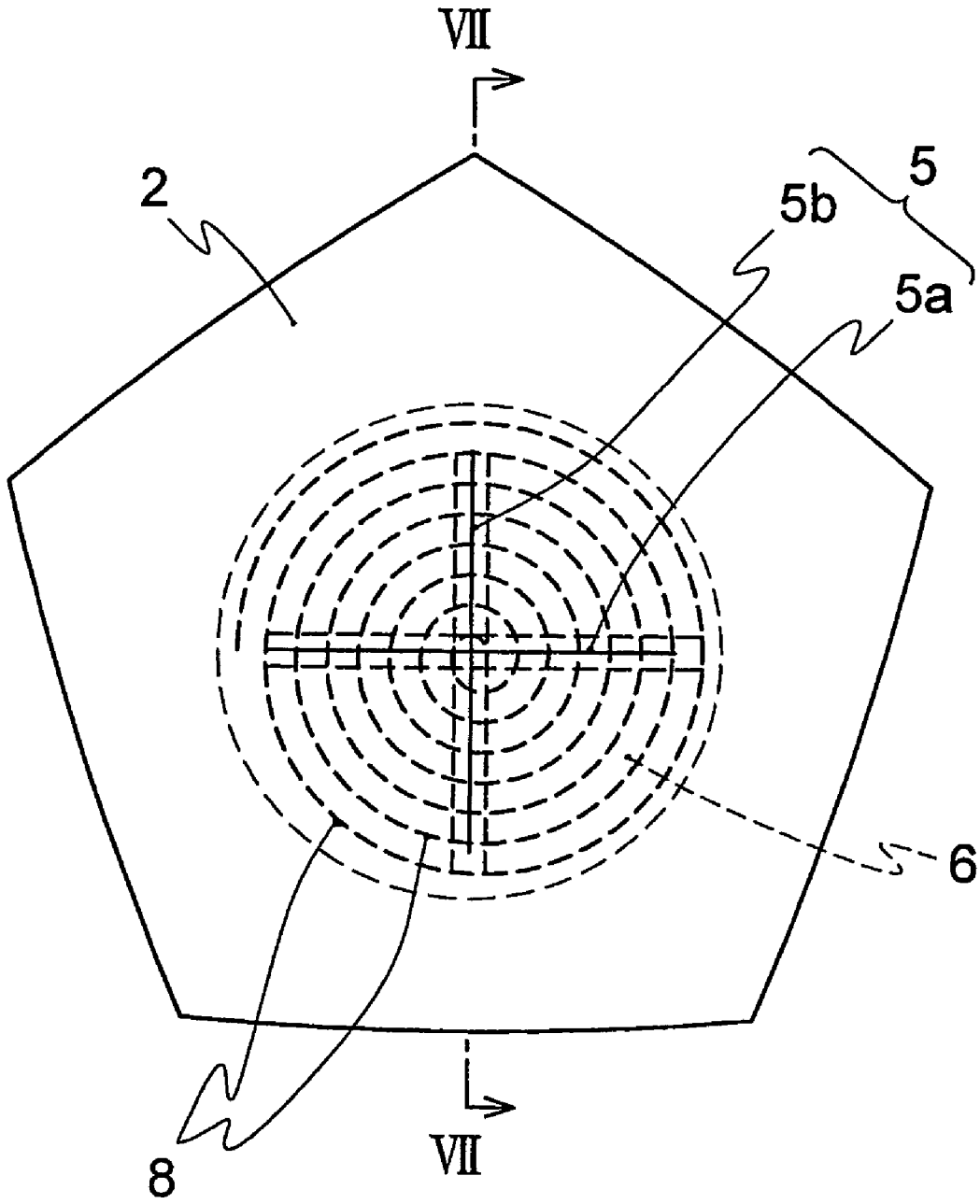
FIG. 6 is a front view of another closing structure of a fabric piece seen from an inside of the ball, said fabric piece having a slit-like shaped hole for reversing the fabric layer and accommodating a bladder.
Figure 7:
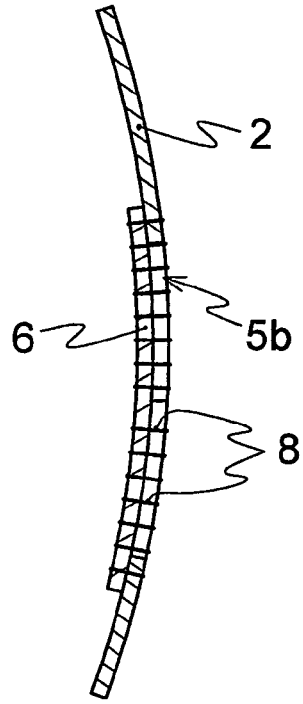
FIG. 7 is a cross sectional view taken on line of VII-VII of FIG. 6.

In order to assuredly secure the patch 6 to the fabric piece 2, as shown in FIGS. 6 and 7, there is employed such a construction where the fabric piece 2 is sewn with the patch 6. That is, after the patch 6 is abutted to the fabric piece 2 from inside of the fabric layer 1, the patch 6 and the fabric piece 2 are sewn along the slits 5*a*, 5*b*, and sewn in a spiral shape using a sewing thread by a sewing machine or a hand. In that case, the patch 6 is located inside the fabric layer 1 as mentioned above.

Figure 8:
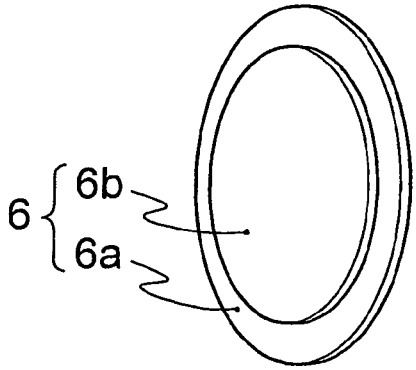
FIG. 8 is a perspective view showing a patch of another embodiment of the invention.

In FIG. 8, there is shown another embodiment of the patch 6 comprising two discs 6*a*, 6*b* made of fabric adhered to each other with adhesive. A diameter of one of the two discs is different from a diameter of the other one of the two discs. Each of the discs 6*a*, 6*b* has the same construction as the fabric piece 2 where two sheets made of fabric are adhered to each other. For instance, the disc 6*a* has a diameter of 60 mm and the disc 6*b* has a diameter of 40 mm, and the disc 6*a* of the patch 6 is adhered to the fabric piece 2 with adhesive. Since the balance of the weight of the patch 6 against the weight of the valve of the bladder is considered, the disc 6*b* is added. The weight of the normal valve is about 4.5 g. However, the weight of the patch having only the disc 6*a* is somewhat smaller than 4.5 g. For that reason, the weight of the patch 6 is set in such a manner that the weight of the patch 6 is equal to that of the valve (I.e., 4.5 g) by adding the disc 6*b*. Please note that there is achieved such an effect where the balance of the weight of the patch 6 against the weight of the valve is improved, even if the patch 6 is composed of only the disc 6*a*.

Figure 9:
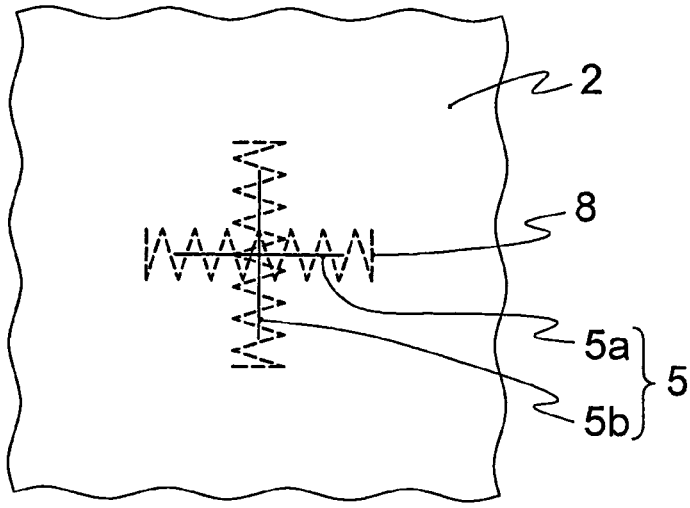
FIG. 9 is a front view of still another closing structure of a fabric piece seen from an inside of the ball, said fabric piece having a slit-like shaped hole for reversing the fabric layer and accommodating a bladder.

FIG. 9 shows the other construction where the hole 5 is closed by sewing the fabric piece 2 in such a manner that zigzagged seam is alternate to each of the slits 5*a*, 5*b* using a sewing thread 8 without using any additional elements such as a patch by means of a sewing machine or hand stitching. Normally, sewing procedure can be performed without allowing the sewing thread loose by a sewing machine whereby a strength of resulting fabrication is greater than that resulting from hand stitching. Accordingly, the fabrication is preferably made by a sewing machine.

Figure 10:
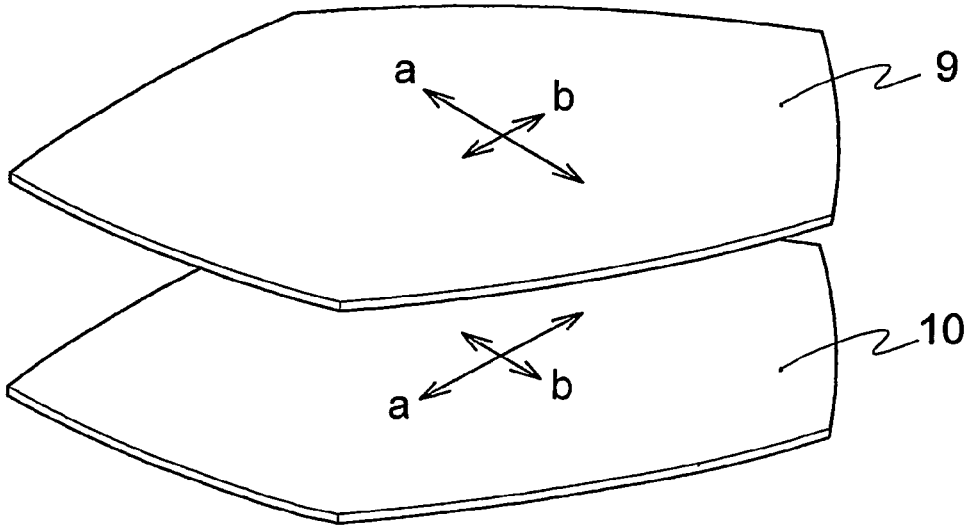
FIG. 10 is a perspective view showing a state where two fabric pieces are not yet adhered to each other.

As shown in FIG. 10, the fabric piece 2 of this embodiment is comprised of two right pentagonal plain woven fabric sheets (hereinafter referred to as pentagonal fabric sheets) 9, 10. The two pentagonal fabric sheets 9, 10 are arranged in such a manner that a warp direction a of the fabric sheet 9 are perpendicular to a warp direction a of the fabric sheet 10, and thereafter the fabric sheet 9 is adhered to the fabric sheet 10 with adhesive having tackiness such as latex paste. As a result, the total tensile strength of the warp direction a of the fabric sheets 9 and 10 is equal to that of a weft direction b of the fabric sheets 9 and 10. Normally, in the plain woven fabric the tensile strength of the warp is greater than that of the weft direction. For that reason, when the plain woven fabric is used under the condition where there is a difference of the strength between the warp direction and the weft direction, the plain woven fabric is extended faster in the weft direction to cause a deformation. Accordingly, the fabric piece 2 of this embodiment has a construction as mentioned above.

The fabric piece 2 tends to extend in the direction 45 degrees to the warp direction a (or the weft direction b) due to a bias effect, the shock applied to the ball is absorbed and relaxed. As the material for the fabric piece 2, cotton, blend of cotton and polyester, high strength fiber fabric such as Kevlar (trade name) might be used.

In the embodiment mentioned above, there is explained such a case where the fabric piece 2 is comprised of two plain woven fabric sheets 9, 10 which are laminated and adhered to each other. The number of plain woven fabric sheet for constituting the fabric piece is not limited to two, three or more might be used. Please note, if the fabric piece 2 is comprised of three plain woven fabric sheets, the tensile strength of the warp direction a of one of the three plain woven fabric sheets is required to be set in such a manner as to be equal to total tensile strength of the warp direction a of the other two plain woven fabric sheets. Further, the fabric piece 2 is comprised of four plain woven fabric sheets, it is necessary to arrange the same in such a manner that the plain woven fabric sheets having a tensile strength equal to each other are alternately laminated and adhered to each other, and the warp direction a of one of the laminated sheets is perpendicular to the warp direction a of the other one of the laminated sheets adjacent to the above-mentioned one of the laminated sheets. In short, the fabric sheets constituting the fabric piece 2 should be arranged in such a manner that as the total fabric piece 2, a tensile strength of the warp direction a is equal to a tensile strength of the weft direction b.

Figure 11:
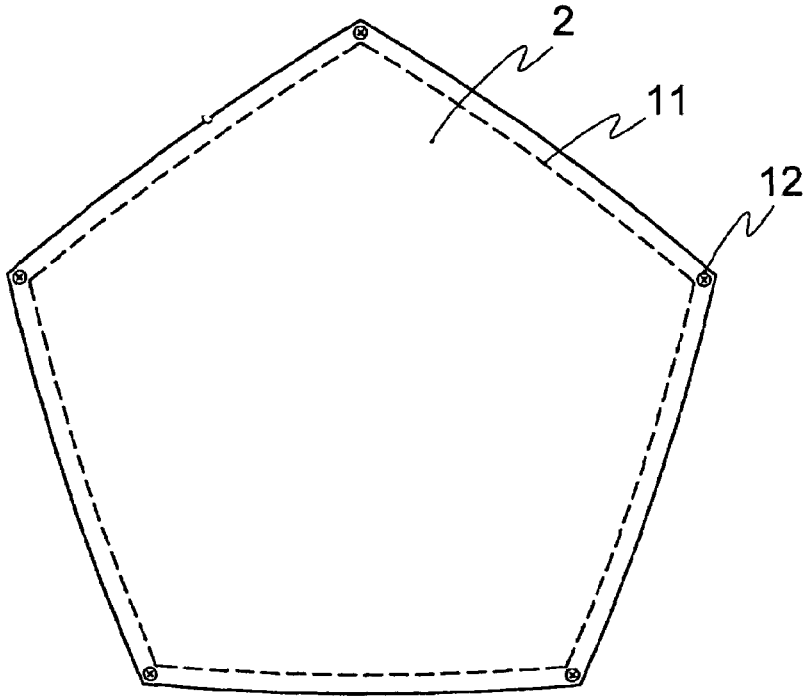
FIG. 11 is a front view showing the fabric piece.

As shown in FIG. 11, the fabric piece 2 is constructed to have a right pentagonal shape, particularly to have such a shape where each of five sides (or leading edges) is outwardly projected to have such a radius of curvature as to obtain a spherical body when the required number of the fabric pieces are sewn together. A length of any one of the five sides is equal to that of the other one of the five sides. Numeral 11 shows a guiding line for sewing procedure which is printed along the sides, and numeral 12 shows a marking printed between the guiding line and the side at each vertex. The marking 12 is used for alignment.

Figure 12:
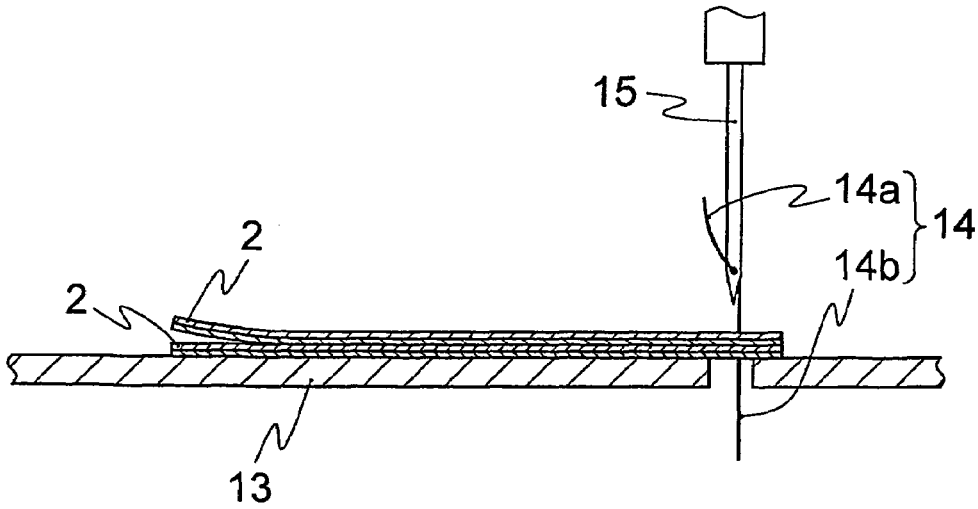
FIG. 12 is a cross sectional view for explaining how to sew the fabric pieces together.

As shown in FIG. 12, after two fabric pieces 2 are superimposed with each other, the superimposed fabric pieces 2 are located on a sewing table 13 of the sewing machine, then the superimposed fabric pieces are sewn together along the guiding line 11 with a sewing thread 14 consisting of an upper thread 14*a* and a lower thread 14*b*. Numeral 15 shows a sewing needle. If a seam is departed from the guiding line 11, a spherical body as designed cannot be formed from the fabric layer 1. For that reason, the seam should be exactly located. The guiding line 11 plays an important role for sewing exactly along the prescribed curve. Thus, all of the sides of twelve fabric pieces are sewn together. At that time, marginal edges 16 (please see FIG. 3) to be sewn, which are located outside the guiding line 11 under such a condition as to be folded at right angle. Please note that the guiding line is not needed, if an electronic sewing machine where any sewing line can be set by means of a program.

After the completion of the sewing procedure, the fabric layer 1 is reversed using the hole 5. As a result, the marginal edge 16 (please see FIG. 3) is locate inside the fabric layer 1. The bladder is accomodated through the hole 5 into thus obtained spherical shaped fabric layer 1.

Figure 13:
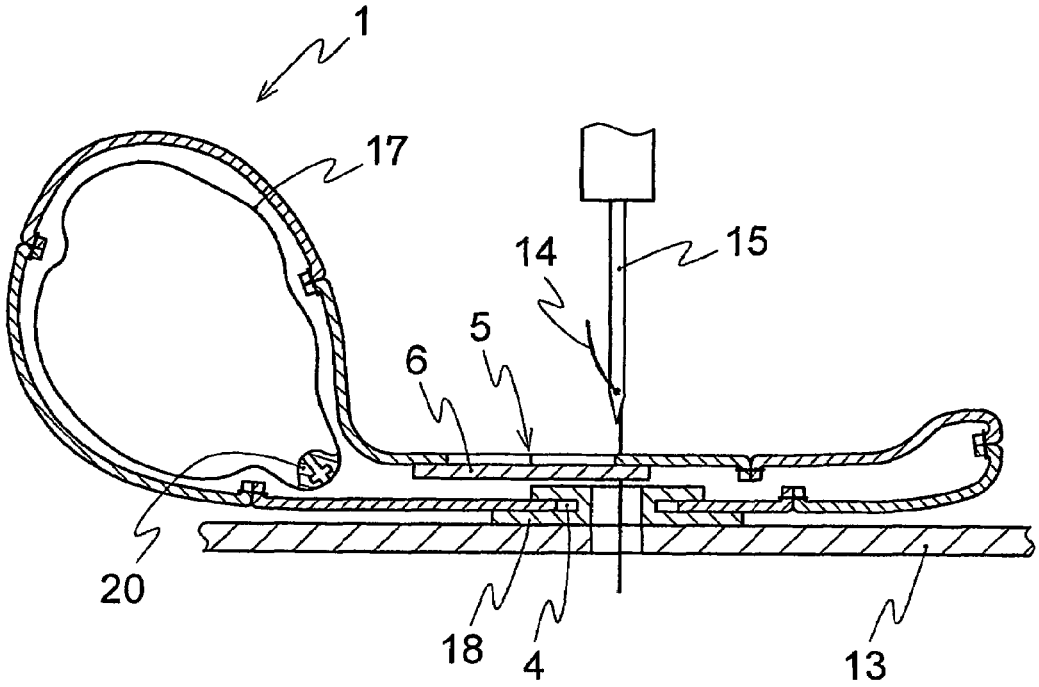
FIG. 13 is a cross sectional view showing a construction where the fabric piece is sewn with the patch.
Figure 14:
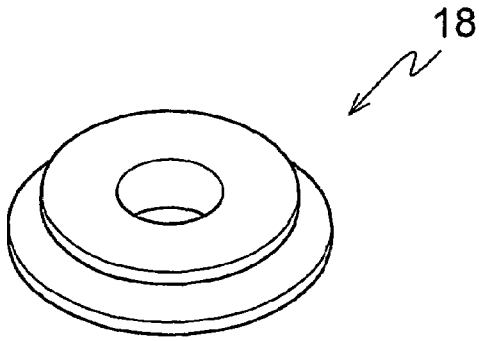
FIG. 14 is a perspective view showing a fixture.

FIG. 13 shows a construction where a patch 6 is abutted to the inside of the fabric layer 1 to cover the hole 5, and the patch 6 and fabric layer 1 are sewn together. As shown in FIG. 13, after the bladder 17 is accommodated into the fabric layer 1, the valve opening 4 located just under the needle 15 of the sewing machine is engaged with a thin fixture 18 (please see FIG. 14) having a cylindrical part, where the cylindrical part is provided with flange parts on upper and lower side thereof. The outside diameter of the cylindrical part is substantially the same as the diameter of the valve opening 4. A peripheral part of the valve opening 4 is interposed between the flange parts, thereby the valve opening 4 in the fabric layer 1 is fixed just under the needle 15 of the sewing machine. In that condition, the hole 5 in the fabric layer 1 is closed by the sewing procedure using the sewing thread 14. The procedure is called "closure sewing". At that time, the bladder 17 is biased to one side of the space within the fabric layer 1, for fear that the bladder 17 may collide against the needle 15. Preferably, the sewing thread, yarn count of which is five, is made of polyester or the like. As mentioned above, the sewing thread 14 is composed of the upper thread 14*a* located on the upper side of fabric layer 1 and the lower thread 14*b* located on the lower side of fabric layer 1. By virtue of the closure sewing, the layer 1 can be formed to have a closed spherical shape. The closure sewing is performed by not only the sewing machine, but also hand stitching after the patch 6 is abutted to the inside of the fabric layer 1. In that case, after a finger is inserted through the hole 5, the fabric layer 1 and the patch 6 are sewn by using a needle while pinching the fabric layer 1 and the patch 6 by the finger and a thumb. When the hole becomes too narrow to insert the finger, after the finger is pulled out, the fabric layer 1 and the patch 6 are sewn together while the fabric layer 1 and the patch 6 are pinched by a finger and a thumb, and the patch 6 is abutted to the valve opening 4. Normally, in the closure sewing there is needed a special sewing machine, of which construction is different from that of the sewing machine used for sewing the other part. However, even in the closure sewing by hand stitching, the hole 5 is closed without using the special sewing machine.

Figure 15:
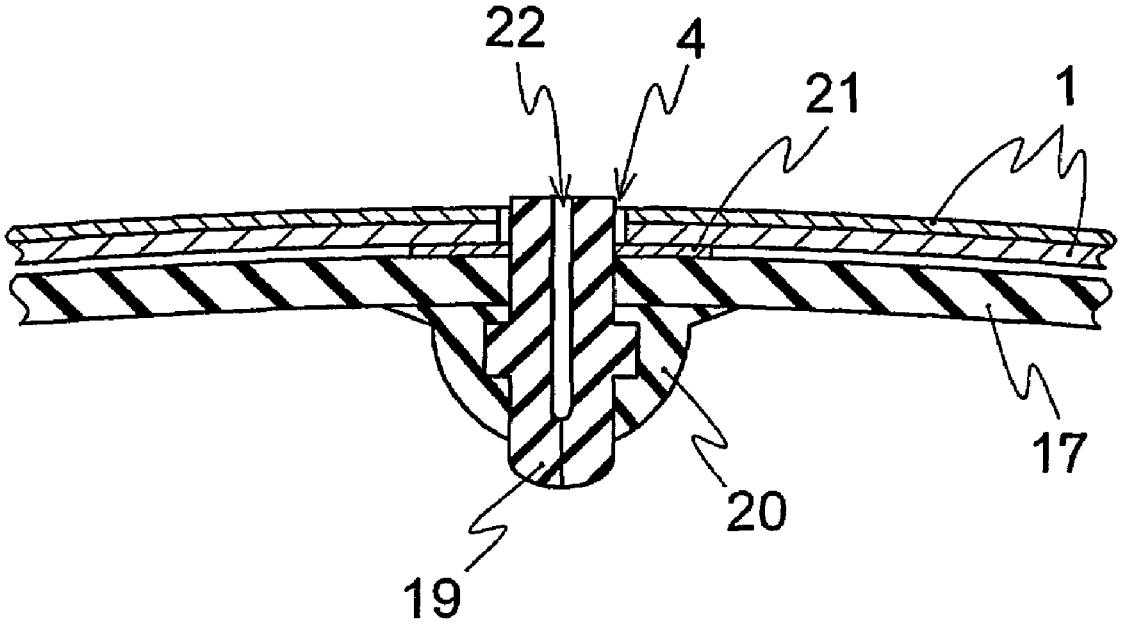
FIG. 15 is a cross sectional view showing a valve of the bladder and the fabric layer.

As shown in FIG. 15, the valve 19 and a valve holding part 20 are fixed in the bladder 17, and on a surface located in a peripheral part of the valve 19 there is provided a disc-like shaped patch 21 adhered to the valve 19. The valve holding part 20 and the disc-like shaped patch 21 are vulcanized so as to be adhered to the bladder 17 while the bladder 17 is vulcanized. The valve holding part 20 and the disc-like shaped patch 21 might be adhered to the bladder 17 with adhesive. After the bladder 17 is vulcanized, the valve 19 is engaged with an opening formed at the center of the valve holding part 20. At the center of the valve 19, there is formed an aperture 22 through which air is introduced into the bladder 17 by means of an air supplying needle which is inserted into the aperture.

After the hole 5 is closed, the valve 19 is aligned with the valve opening 4, and the disc-like shaped patch 21 is adhered to an inner side of the fabric layer 1 with adhesive. With regard to a part located between the fabric layer 1 and the bladder 17 other than the adhered part, the fabric layer 1 is merely contacted with the bladder 17.

The bladder 17 made of a rubber having no air permeability such as latex rubber, butyl rubber is formed into a hollow spherical body. Air pressure to be set within the bladder 17 is about 1.0 kgf/cm2. The air pressure is achieved by filling air through the air supplying needle from an air pump, wherein the air supplying needle is inserted into the aperture 22 formed in the valve 19.

Figure 16:
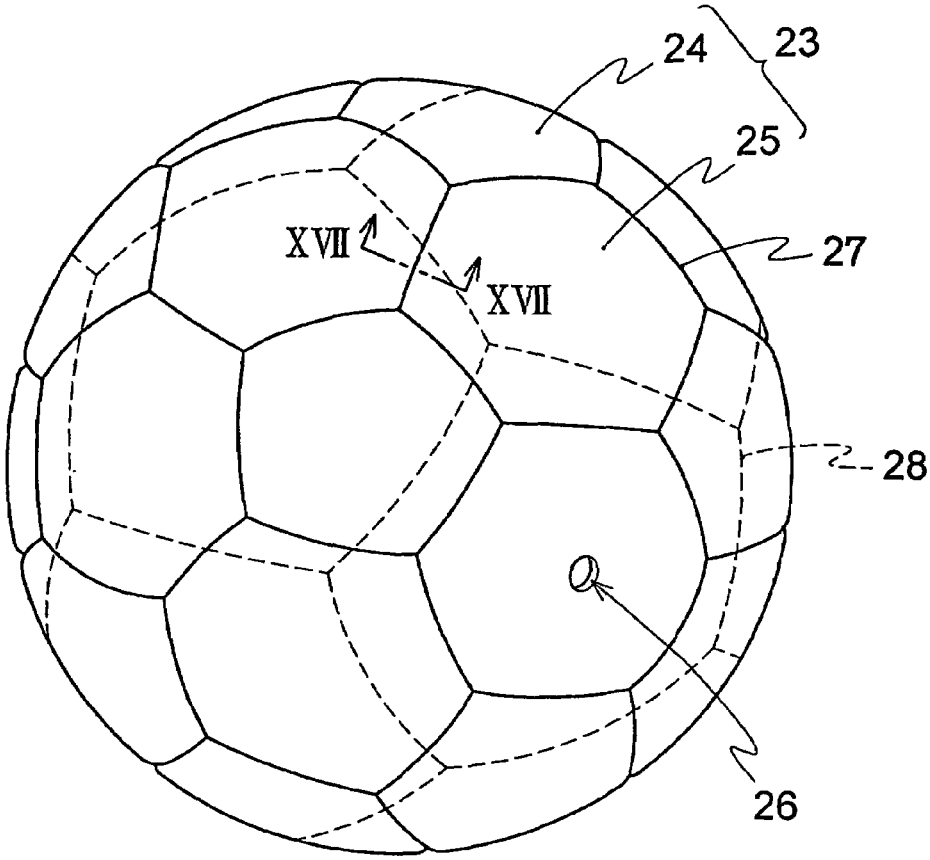
FIG. 16 is a perspective view showing a completed state of the ball.
Figure 17:
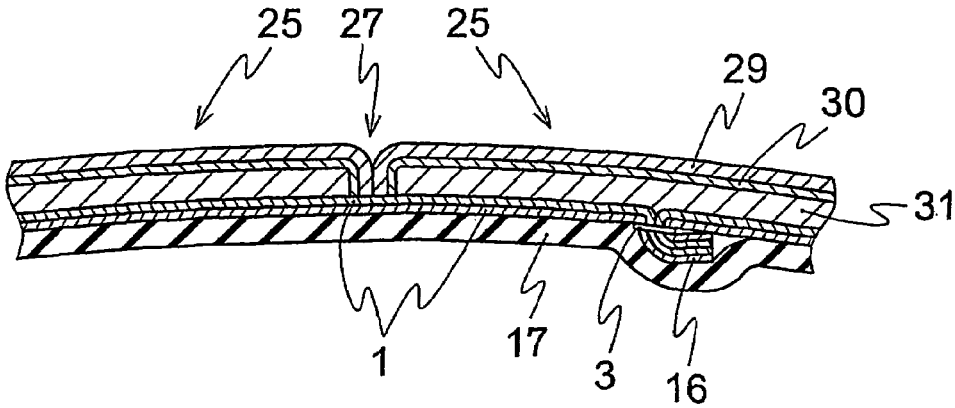
FIG. 17 is a cross sectional view taken on line of XVII-XVII of FIG. 16.

In FIGS. 16, 17, numeral 23 denotes a skin layer comprising twelve pentagonal panels 24 and twenty hexagonal panels 25 adhered onto the fabric layer 1 with adhesive such as chloroprene rubber adhesive, natural rubber adhesive. The whole of a surface of the fabric layer 1 is completely covered with the thirty-two panels 24, 25 with no gap. For that reason, the marginal edges of one of the panel 24 or 25 is contacted with the marginal edges of the other one of the panel 24 or 25.

Suitable materials for the panels 24, 25, are synthetic leather, polyvinyl chloride resin leather, thermoplastic polyurethane film, polyurethane foam having a polyurethane thin film on a surface thereof and natural leather. The skin layer 23 comprising thirty-two panels 24, 25 has such a spherical shape which is obtained by somewhat outwardly expanding a semi dotriacontahedron which is a kind of a polyhedron. Numeral 26 denotes a valve opening formed in the hexagonal panel 25. The valve opening 26 corresponds to the valve opening 4 formed in the fabric layer 1.

The panels may alternatively be formed into a right dodecahedron using twelve pentagonal panels in the same manner as the fabric layer 1. Also, preferably in that case, each peripheral edge of the panels is curved outwardly to obtain a spherical shape.

Preferably, a connecting line 27 of adjacent panels 24, 25 and a seam line 28 of the fabric pieces 2 are arranged in such a manner that the connecting line 27 is not superimposed on the seam line 28. Each seam line 28 in the fabric pieces 2 has an enough strength to keep the whole fabric pieces spherical, nevertheless the tensile strength of the seam line 28 is smaller than that of peripheral part of the seam line 28. Similarly, the tensile strength of the connecting part of the adjacent panels 24, 25 located at the connecting line 27 is smaller than that of the peripheral part of the connecting line 27. Accordingly, the seam line 28 of the fabric pieces and the connecting line 27 of adjacent panels 24,25 are arranged in such a manner that the seam line 28 and the connecting line 27 are crossed and the lower strength parts are scattered on the spherical surface in order to avoid crossing of the seam line 28 and the connecting line 27 as little as possible.

As shown in FIG. 17, the marginal part 16 to be sewn in the fabric piece 2 is folded by about 90, so that the marginal part 16 is inwardly projected. However, the inwardly projected marginal part 16 is pressurized by the bladder 17 and further folded in such a manner that the marginal part 16 is contacted with the rear side of the fabric piece 2.

The inwardly projected part is absorbed by a deformation of the bladder 17. For that reason, the inwardly projected part does not affect the spherical shape, and a complete spherical surface having no unevenness in the fabric layer 1 is kept smooth. Between the fabric layer 1 and the skin layer 23, a rubber covering layer (not shown) might be interposed in order to enhance the adhesive strength of the fabric layer 1 and the skin layer 23.

Each of the panels 24, 25 is comprised of a leather or leather like surface layer (hereinafter referred to as surface layer) 29, a panel cloth layer 30 provided on a rear surface of the surface layer 29, and a shock absorbing layer 31 made of a foam material. The marginal edge of the surface layer 29 and the panel cloth layer 30 are folded in such a manner that the end of the marginal edge is circularly turned by about 90 degrees to the rear side of the skin layer 23. The surface layer 29, the panel cloth layer 30 and the shock absorbing layer 31 are adhered to each other with adhesive such as latex paste. The side surface of the shock absorbing layer 31 is also adhered to the panel cloth layer 30. The leading edge of the surface layer 29 and the panel cloth layer 30 and the rear side of the shock absorbing layer 31 are adhered to the fabric layer 1.

The shock absorbing layer 31 served as not only an element for absorbing and relaxing a shock, but also an element for adjusting a thickness to keep a thickness of the panels 24, 25 constant. In the connecting part 27, there is formed a narrow/steep groove having the same shape as that of a hand stitched ball with a construction where marginal edges of adjacent panels are inwardly folded by 90 degrees so as to be sewn together. In the lower side of the groove, the adjacent surface layers 29 are joined to each other, and can be adhered to each other with adhesive. Thereby, the adjacent surface layers 29 in the connecting part 27 are closely contacted with each other, any gap between adjacent surface layers is prevented from generating. As a result, water is prevented from entering. Further, the ball for ball game of this embodiment has groove similar to that in the hand stitched ball has an effect where a gripping property is enhanced and the flying distance is increased.

Further, if corrugated like shaped unevenness is consecutively formed by intermittently subjecting the leading edges which are circularly turned to high-frequency work or intermittent adhering in such a manner as to be spaced apart from each other by predetermined distance (about 4 to 5 mm), a pseudo sewing line similar to a sewing line of hand-stitched ball can be obtained.

In addition to the construction of the panel cloth layer 30 and the shock absorbing layer 31, there might be employed such a construction comprising a plurality of the panel cloth layers 30 laminated with each other, or a construction comprising a plurality of the panel cloth layers 30 and a plurality of the shock absorbing layers 31 laminated with each other in addition to the construction mentioned above. However, in view of the enhancement of shock absorbing and relaxing effect, it is preferable to employ the construction where the shock absorbing layer 31 is interposed between the surface layer 29 and the fabric layer 1.

Suitable materials for the panel cloth layer 30 are woven fabric or non-woven fabric. The panel cloth layer 30 reinforces the panels 24, 25 and the adhering strength of the skin layer 29 and the shock absorbing layer 31 are improved. However, the panel cloth layer 30 is not necessarily required, and the panel cloth layer 30 might be omitted, if an adhesive with a high adhering strength is used.

Suitable materials for the shock absorbing layer 31 are preferably a sheet made of foaming material selected from a group consisting of chloroprene, polyurethane, EPDM, polyethylene, EVA (ethylene vinyl-acetate copolymer), SBR and NR. By adjusting a cushioning property of the shock absorbing layer 31, the bouncing height of the ball can be adjusted.

Instead of the panels 24, 25 having the construction mentioned above, the panels which are employed in the conventional laminated ball might be used. In that case, marginal edge of the panels are obliquely cut off, so that in the connecting part of adjacent panels there is formed a V-like shaped shallow groove.

Figure 18:
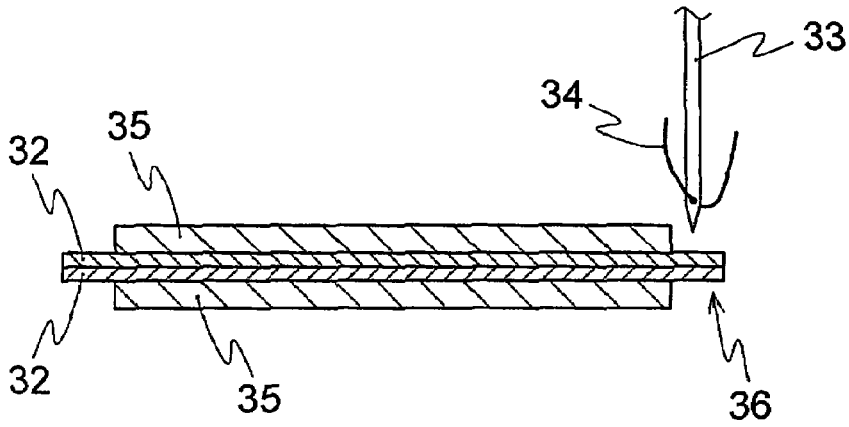
FIG. 18 is a cross sectional view showing another construction of a skin layer.
Figure 19:
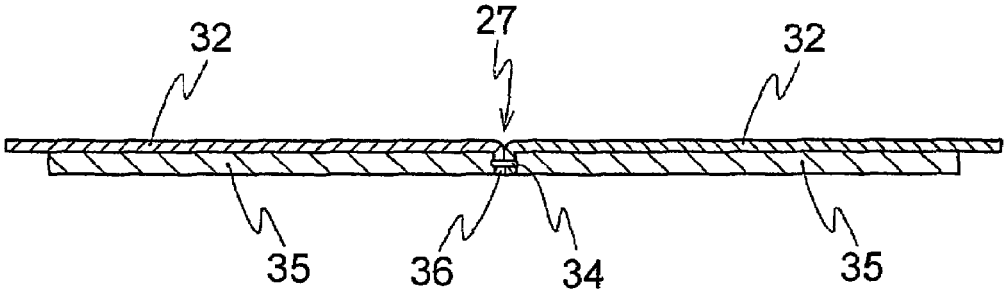
FIG. 19 is a cross sectional view showing an unfolded state of a panel having a construction shown in FIG. 18.

FIG. 18 shows a skin layer having a construction different from the construction mentioned above. That is, in this embodiment shown in FIG. 18, there is employed such a construction where after two panels 32 are superimposed in such a manner that a surface of one of the two panels 32 is in contact with a surface of the other one of the two panels 32, then the marginal edges of the superimposed panels 32 are sewn together with a sewing machine. The panels 32 might be made from a synthetic leather comprising a skin layer made of polyurethane where the rear side of the skin layer is reinforced by a non-woven fabric layer. Numeral 33 denotes a needle for a sewing machine, numeral 34 denotes a sewing thread, numeral 35 denotes a shock absorbing layer adhered to the rear surface of the panels 32, the shock absorbing layer being made of foaming material. The panels 32 where the marginal edge of the same is sewn together are unfolded in such a manner that the marginal edge sewn together is located on the inner side of resulting ball as shown in FIG. 19. The marginal edge of any one of the panels 32 is sewn together with the marginal edge of the other one of the panels 32 adjacent to the one of the panels 32 to form a spherical skin layer. In that case, closure sewing is performed by hand stitching.

In the conventional hand stitched ball, there is no reinforcing layer such as a woven fabric layer. For that reason, a so-called backing cloth is adhered to the rear surface of each of the panels, so that the panels do not bend easily. As a result, such a sewing procedure cannot be performed with a sewing machine. On the other hand, according to the ball of the present invention having the construction as mentioned above, the fabric layer serving as a reinforcing layer is provided in such a manner as to cover the bladder. For that reason, on the rear surface of the panel it is not required to have any woven fabric (a so-called backing cloth), the panel of the present invention is soft and easy to bend. As a result, the sewing procedure can be performed with a sewing machine.

In the construction of the ball of the present invention, the region where the fabric layer is adhered to the skin layer is located only in a peripheral part of the valve opening, and the fabric layer is not adhered to the skin layer in the region other than the peripheral part of the valve opening. That is, the ball of the present invention has a greater part where the fabric piece is not adhered to the skin layer. In other words, in the greater part the fabric piece is merely coming into contact with the skin layer. Accordingly, the fabric layer can slide relative to the skin layer, whereby the shock absorbing properties of the ball are improved, and the ball of the present invention can be softly collided against the human body. Please note that in the construction mentioned above, the stitching strength of the skin layer of the present invention cannot be so high as the strength of the conventional hand stitched ball. However, the strength totally required as a ball can be maintained, because the fabric layer is defined as the reinforcing layer.

In the foregoing embodiment, the example where the ball of the present invention is applied to a soccer ball is explained. The ball of the present invention can be applied to any ball having the same construction as that of the present invention, for instance to a volley ball, a handball, a basketball or the like.

INDUSTRIAL APPLICABILITY

According to claim 1 of the invention, all of the marginal edges to be sewn are located on the inner side of the fabric layer. Therefore, any projected part is not generated on the surface, and a spherical surface having smooth skin layer can be achieved. In the conventional ball, fine unevenness such as projected parts of the marginal edge to be sewn appear on the surface of the fabric layer to give rise to so-called a mirror-through effect on the surface of the panels. By virtue of the construction of the invention, the ball of the invention can be prevented in such a manner as not to depart from the desired locus of the flying ball. Further, the ball having smooth surface is attained and the appearance of the ball is improved.

Further, according to the invention, the fabric pieces are sewn by a sewing machine. For that reason, the sewing procedure is performed in a reduced time, and stable quality such as a tensile strength of a sewing thread is attained.

According to claim 2 of the invention, a patch is abutted onto a peripheral part of said hole for accommodating said bladder, and said patch is adhered to said fabric piece whereby said hole is closed. Thereby, the fabric layer having closed spherical fabric layer is completed. Further, by virtue of the construction mentioned above, the work for closing the hole is easily performed. Further, since the hole is located to oppose to the valve, the patch serves as a means for balancing the weight to the valve, and the center of gravity of the ball substantially corresponds the geometrical center of the ball. As a result, the ball of the invention can be prevented in such a manner as not to depart from the desired locus of the flying ball.

According to claim 3 of the invention, said patch is sewn together with said fabric piece, the strong bonding strength is attained. Further, the patch and the fabric piece can be sewn together by a sewing machine under the condition that a needle of the sewing machine is passed through the valve opening. For that reason, the sewing procedure can be easily performed in a reduced time, and stable quality such as a tensile strength of a sewing thread is attained. Furthermore, the patch serves as a means for balancing the weight to the valve as mentioned above. The patch can be sewn together with the fabric piece by hand stitch as described in claim 4. In that case, any special sewing machine for closing the hole is not needed.

According to claim 5 of the invention, the cross-like-shaped slit can be completely closed. As a result, the strength in the patch is constantly maintained, the spherical shape can be maintained, even if the fabric layer is subjected to pressure from the bladder. By setting the length of the slits in a range where both the requirement (minimum length) for reversing the fabric layer and the requirement (maximum length) for preventing a degradation of the strength of the fabric layer are met, the spherical fabric layer can be manufactured with relative ease in a shortened time period and without degrading too much the durability of the fabric piece with the slit.

According to the claim 6 of the invention, the slit is closed by for instance such a procedure of sewing alternately the periphery of the slits by a sewing machine. Thereby, by the sewing procedure, the hole is closed to complete a spherical fabric layer, the restitution property and the flexibility of the parts which are sewn together are maintained in the same values of the periphery of the slit.

According to claim 7 of the invention, said fabric layer is comprised of twelve right pentagonal fabric pieces. Thereby, twelve right pentagonal fabric pieces are sewn together to form a right dodecahedron (12-hedrodn). As a result, a spherical body is obtained by spherically and outwardly deforming each plain constituting the right dodecahedron. For that reason, substantially equal tensile strength is applied to each side of the 12-hedron, and the sphericity of the ball can be attained with high precision.

According to claim 8 of the invention, since the fabric piece is composed of at least two sheets of woven fabric laminated to each other, the strength of the warp direction is substantially equal to the strength of weft direction. As a result, the amount of the deformation in the warp direction is substantially equal to the amount of the deformation in the weft direction. Accordingly, the spherical shape of the fabric layer (i.e., the spherical shape as the ball) is maintained in the long interval.

According to claim 9 of the invention, the cushion property of the panels are improved by the shock absorbing layer. In the connecting part between the adjacent panels, there is formed a steep grooves having V-like shape in section. The gripping property of the ball is improved and air resistance is lowered by the grooves, so that flying distance is increased.

According to claim 10 of the invention, said inwardly turned marginal edge of one of said plurality of panels is adhered to said inwardly edge of the other one of said plurality of panels adjacent to said one of said plurality of panels with adhesive. Thereby, the connecting face of adjacent panels are firmly connected without generating any gap. As a result, a problem in the conventional ball where rainwater is entered within the ball through the gap to increase the weight of the ball, or another problem where the panels are easily peeled off is eliminated.

According to claim 11 of the invention, said skin layer is formed by superposing two panels, sewing marginal edge of said superimposed panels, and turning said marginal edge by 90 degrees which are sewn together in such a manner that said marginal edge is located on an inner side. That is, the formation of the spherical skin layer is performed without another element such as a bladder. Such a construction where the skin layer is coming into contact with the bladder can be employed, whereby both the skin layer and the bladder are freely moved, a shock absorbing property is increased, and soft feeling ball is attained. Further, sewing quality such as sewing strength between adjacent panels can be stable by means of a sewing machine.

According to claim 12 of the invention, said turned skin layer is adhered to said fabric layer with adhesive. Thereby, the connecting face of adjacent panels are firmly connected without generating any gap. As a result, a problem in the conventional ball where rainwater is entered within the ball through the gap to increase the weight of the ball, or another problem where the panels are easily peeled off is eliminated. According to claim 13 or claim 14 of the invention, in the surface of the spherically formed fabric layer there are completely eliminated fine level differences caused by partial superposing of the fabric pieces and unevenness. As a result, high sphericity can be attained throughout the fabric layer, and smooth spherical surface in any parts of the fabric layer can be achieved in all of the surface on the fabric layer. As a result, the sphericity and smoothness of the skin layer formed on the fabric layer comprising the panels are increased, the ball of the invention can be prevented in such a manner as not to depart from the desired locus of the flying ball, and the property of controlling the ball is attained.

The invention claimed is:

1. Method for manufacturing a ball for a ball game, said ball comprising:

(a) a bladder including a valve for introducing air into said bladder;

(b) a fabric layer located on an outer surface of said bladder comprising a plurality of fabric pieces, wherein each of said plurality of fabric pieces has marginal edges which are folded inwardly, wherein said marginal edges of adjacent fabric pieces are sewn together with a sewing machine, so that said plurality of fabric pieces are joined to have a spherical shape, wherein a valve opening is formed in a first one of said plurality of fabric pieces, and a hole for reversing said fabric layer and for accommodating said bladder is formed in a second one of said plurality of fabric pieces wherein the second one of said plurality of fabric pieces is located opposite the first one of said plurality of fabric pieces; and (c) a skin layer located on an outer surface of said fabric layer, said skin layer comprising a plurality of panels;

said method comprising the steps of:

(i) forming the fabric layer by superposing two adjacent fabric pieces, sewing along a marginal edge of the superimposed fabric pieces with a sewing machine, locating said marginal edge on the outer side of the fabric layer and repeating until all fabric pieces are joined to form a spherical fabric layer;

(ii) reversing said fabric layer through said hole to locate said marginal edges on an inner side of the fabric layer;

(iii) inserting said bladder into the fabric layer through said hole within said fabric layer;

(iv) closing said hole; and (v) forming said skin layer on the outer surface of said fabric layer.

2. The method of claim 1, wherein a patch is abutted onto a peripheral part of said hole, and said patch is adhered to said second one of said fabric pieces whereby said hole is closed.

3. The method of claim 1, wherein a patch is abutted onto a peripheral part of said hole, said patch is sewn to said second one of said fabric pieces with a sewing machine through said valve opening formed in said fabric layer.

4. The method of claim 1, wherein a patch is abutted onto a peripheral part of said hole, said patch is sewn to said second one of said fabric pieces by hand stitching.

5. The method of claim 1, wherein said hole comprises two slits, which perpendicularly bisect each other, said slits having a minimum length of 20 mm.

6. The method of claim 1, wherein said hole comprises two slits, which perpendicularly bisect each other, said slits having a maximum length which is determined by a distance from ends of said slits to peripheral edges of said second one of said fabric pieces being at least 10 mm.

7. The method of claim 6, wherein said hole is closed through said valve opening using a sewing machine.

8. The method of claim 1, wherein said fabric layer comprises twelve right pentagonal fabric pieces.

9. The method of claim 1, wherein each of said fabric pieces comprises two fabric layers laminated to each other, whereby a warp direction of a first fabric layer is perpendicular to a warp direction of a second fabric layer.

10. The method of claim 1, wherein each of said plurality of panels comprises a surface layer and a shock absorbing layer adhered to a rear surface of said surface layer, wherein marginal edges of said surface layer are inwardly turned by 90 degrees, whereby side surfaces of said shock absorbing layer are covered with said inwardly turned marginal edges, and wherein said panels are adhered to said fabric layer with adhesive.

11. The method of claim 10, wherein an inwardly turned marginal edge of one of said plurality of panels is adhered to an inwardly turned edge of an adjacent panel with adhesive.

12. The method of claim 1, wherein said skin layer is formed by superposing two adjacent panels, sewing marginal edges of said superimposed panels together, opening out the superimposed panels in such a manner that said marginal edges are located on an inner side of the skin layer and repeating until all the panels are joined to form a spherical skin layer.

13. The method of claim 12, wherein said skin layer is adhered to said fabric layer with adhesive.

14. Method for manufacturing a ball for a ball game, said ball comprising:

(a) a bladder including a valve for introducing air into said bladder;

(b) a fabric layer located on an outer surface of said bladder comprising a plurality of fabric pieces, wherein each of said plurality of fabric pieces has marginal edges which are folded inwardly, wherein said marginal edges of adjacent fabric pieces are sewn together with a sewing machine, so that said plurality of fabric pieces are joined to form a spherical shape; and (c) a skin layer located on an outer surface of said fabric layer, said skin layer comprising a plurality of panels;

said method comprising the steps of:

(i) forming a hole in one of said plurality of fabric pieces;

(ii) superimposing two adjacent fabric pieces, sewing along a marginal edge of the superimposed fabric pieces with a sewing machine, locating all of said marginal edges on an outer side of the fabric layer and repeating until all fabric pieces are joined to form a spherical fabric layer;

(iii) reversing said fabric layer through said hole, and locating all of said marginal edges on an inner side of the fabric layer;

(iv) inserting said bladder into the fabric layer through said hole;

(v) abutting a patch on said hole from the inner side of said fabric layer to close said hole; and (vi) forming said skin layer on the outer surface of said fabric layer.

* * * * *